US008109017B2

(12) United States Patent
Ji et al.

(10) Patent No.: US 8,109,017 B2
(45) Date of Patent: Feb. 7, 2012

(54) STEAMING SYSTEM

(75) Inventors: Lanying Ji, Signapore (SG); Keng Chye Jimmy Ong, Signapore (SG); Asok Kumar Kasevan, Singapore (SG); Yong Jiang, Hoogeveen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 342 days.

(21) Appl. No.: 12/528,093

(22) PCT Filed: Feb. 28, 2008

(86) PCT No.: PCT/IB2008/050719

§ 371 (c)(1),
(2), (4) Date: Aug. 21, 2009

(87) PCT Pub. No.: WO2008/104947

PCT Pub. Date: Sep. 4, 2008

(65) Prior Publication Data

US 2010/0095564 A1 Apr. 22, 2010

(30) Foreign Application Priority Data

Feb. 28, 2007 (EP) ..... 07103184

(51) Int. Cl.
*D06F 75/14* (2006.01)
*A47J 31/54* (2006.01)

(52) U.S. Cl. ..... 38/77.3; 392/441; 210/282

(58) Field of Classification Search ..... 38/77.1–77.6, 38/77.8, 77.81, 77.82; 68/222; 122/13.01, 122/4 A, 451 R; 392/322, 441–448; 210/263, 210/284, 282

See application file for complete search history.

(56) References Cited

U.S. PATENT DOCUMENTS

| | | | | |
|---|---|---|---|---|
| 4,889,041 | A * | 12/1989 | Mahlich et al. | 99/285 |
| 4,893,422 | A | 1/1990 | Mahlich et al. | |
| 5,063,697 | A | 11/1991 | Valente et al. | |
| 5,138,778 | A | 8/1992 | Brandolini | |
| 5,743,034 | A | 4/1998 | DeBourg et al. | |
| 6,163,990 | A | 12/2000 | Urata et al. | |
| 6,351,901 | B1 | 3/2002 | Amsel | |
| 2001/0042326 | A1 * | 11/2001 | Ching et al. | 38/77.3 |
| 2002/0050081 | A1 * | 5/2002 | Ching et al. | 38/77.3 |

FOREIGN PATENT DOCUMENTS

| | | | |
|---|---|---|---|
| EP | 1174539 | A1 | 1/2002 |
| FR | 2632331 | A1 | 12/1989 |
| GB | 1014399 | A | 12/1965 |
| WO | 2006070317 | A1 | 7/2006 |

* cited by examiner

*Primary Examiner* — Ismael Izaguirre

(57) ABSTRACT

A steaming system (100) comprises a steam generator (120), a removable water tank (130) for holding and supplying water to the steam generator (120); and a dosing device (140) for supplying an amount of a water treatment agent to the water tank (130). The dosing device is configured to be triggered by a movement of the water tank (130) relative to the steam generator (120).

7 Claims, 6 Drawing Sheets

STEAMING SYSTEM

FIELD OF INVENTION

This invention relates to a steaming system, more particularly to a steaming system used for ironing devices.

BACKGROUND OF THE INVENTION

A steam generator of a steaming system is typically filled with tap water which normally contains various gases as well as salts. Salts which are customarily found in tap water include sodium bicarbonate, sodium sulfate and magnesium bicarbonate. The percentage of sodium and magnesium salts determines the hardness of water. The heating entails decomposition of water into its constituents, and such constituents, especially carbonates, deposit on the adjacent surfaces in the form of scale. The scale is an insulator of heat so that the energy requirements of the steam generator increase as the thickness of the scale increases. The scale can be carried over with the steam to the outlet of the steam generator, causing the clogging of steam vents and staining users' articles. The steam rate can also be reduced due to the clogging of the steam vents. The common practice is to rinse the steam generator on a regular basis, for example, for every 1 to 2 months, to bring down the scale level and thus to prevent the carry-over.

Another way of improving the situation is to improve the quality of inlet water by pre-treating. The pre-treatment is carried out by using an ion exchange or other anti-scaling agents to remove the calcium and magnesium ions in the inlet water. The treatment agents have to be replaced or re-generated after a certain amount of water treatment.

FR 2632331 discloses a household electrical steam appliance comprising a water reservoir which has a filling orifice. This reservoir communicates with a vaporization chamber. It additionally comprises means for introducing a predetermined quantity of a chemical compound into the water reservoir. This application is especially for preventing the formation of scale in a household electrical steam appliance such as a smoothing iron. However, it is necessary to periodically examine if the corresponding cartridge contains the chemical compound or it must be replaced. In addition, the mechanical dosing device is complex and thus costly.

Therefore, it is an object of the invention to provide a steaming system which does not have the disadvantages of the known steaming system described before, in particular to provide such a steaming system which endows a user with ease of generating quality steam.

This object is achieved by features of the independent claim. Further developments and preferred embodiments of the invention are outlined in the dependent claims.

SUMMARY OF THE INVENTION

According to the invention, a steaming system comprises a steam generator, a removable water tank for holding and supplying water to the steam generator and a dosing device for supplying an amount of a water treatment agent to the water tank. The dosing device is configured to be triggered by a movement of the water tank relative to the steam generator. Each time the removable water tank is disengaged from or engaged to the steam generator, the dosing device is triggered and an amount of the water treatment agent is dosed into water tank. Disengaging the water tank usually means that a user wants to (completely) refill the (empty) water tank. Thus dosing of a predetermined amount of the water treatment agent is correlated to the re-filling of the water tank. This means that the concentration of the water treatment agent in the water tank remains constant. Such an automatic dosing ensures that the water is subjected at all times to an effective treatment without involving any additional action from the user. The water treatment agent provided in the dosing device minimizes the scale formation thereby improving the efficiency of the steam generator. It greatly reduces the frequency of rinsing of the steam generator, thus making the steaming system user-friendly.

According to an embodiment of the invention, the dosing device comprises a cartridge for holding the water treatment agent; a pump for pumping the water treatment agent from the cartridge to the water tank and a valve for balancing air pressure inside the cartridge while the water treatment agent is being pumped. The cartridge contains the water treatment agent intended to reduce the scale formation. The pump delivers the water treatment agent into the removable water tank upon being triggered by the movement of the water tank relative to the steam generator. This operation no longer requires any attention or special handling by a user to add the water treatment agent to the water. The valve provided in the dosing device balances the air pressure inside and outside the cartridge to ensure smooth functioning of the pump.

According to yet another embodiment of the invention, the dosing device further comprises a movable housing for housing the pump, wherein the housing is configured to be moved up and down by the movement of the water tank relative to the steam generator and wherein the pump is configured to be activated by the movement of the housing.

According to yet another embodiment of the invention, the dosing device further comprises a switch for activating the pump, wherein said switch is arranged to be activated as a result of said movement of the water tank relative to the steam generator.

According to a further embodiment, the dosing device further comprises a sensor for sensing the movement of the water tank and for generating a signal. The dosing device also includes a control member for activating the pump based on the generated signal. These embodiments automate the process of adding a water treatment agent to the water used for steam generation.

According to another embodiment, the water treatment agent is an anti-foaming agent, an anti-scaling agent or a combination of both. The anti-scaling agent reacts with the alkalinity of the water in the steam generator and neutralizes the hardness of water. The anti-foaming agent is a mixture of surface active agents those modify the surface tension of water, removes foam and prevents the carry over of fine water particles in the steam. The terms "anti-scaling or anti-foaming" are intended to embrace all types of substances which are used to soften water by removing scale-forming calcium and/or magnesium ions from hard water or replacing them by the more soluble ions, such as sodium ions and which are used to modify the surface tension of water.

According to yet another embodiment, an iron device comprises the steaming system as describe above. The steaming system ensures that there are no scale particles present in the steam generated and thus avoids the clogging of steam outlet openings made in the soleplate of the iron. The configuration of the steaming system described above also prevents the tanning of a garment to be ironed.

DETAILED DESCRIPTION

Figure 1A:
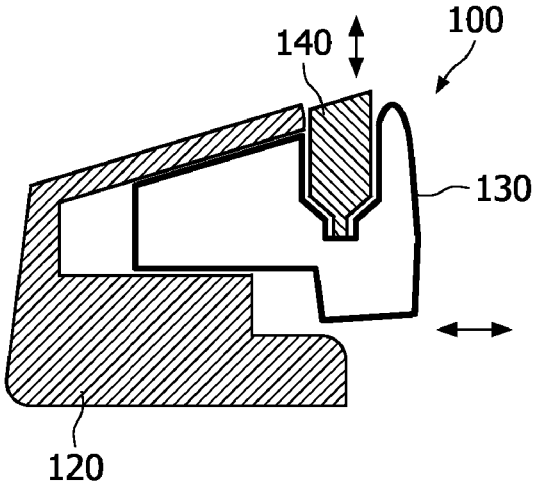
FIG. 1*a* shows a steaming system according to a first embodiment of the invention where a water tank is disengaged.

The present invention will be described with respect to particular embodiments and with reference to certain drawings but the invention is not limited thereto. Any reference signs in the claims shall not be construed as limiting the scope. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

Figure 1B:
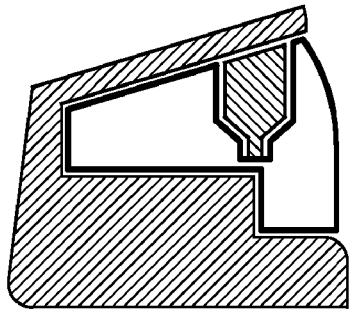
FIG. 1*b* shows the steaming system of FIG. 1*a* where the water tank is engaged.

In FIGS. 1*a* and 1*b,* a steaming system 100 includes a steam generator 120, a water tank 130 and a dosing device 140. The dosing device 140 further includes a pump 141, an outlet 142, a one way valve 143, a cartridge 144 and a housing 145 as shown in FIG. 1*c*.

Figure 1C:
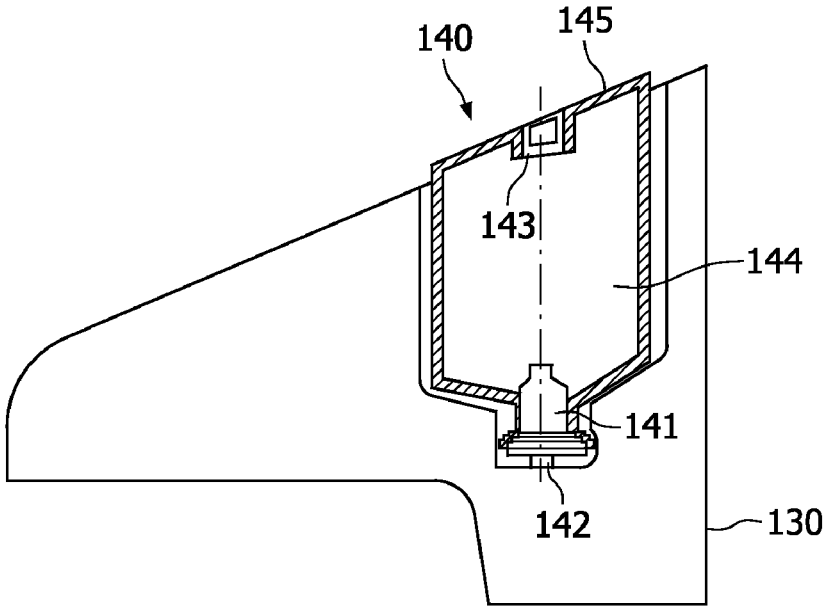
FIG. 1*c* shows an exploded view of a dosing device of FIG. 1*a;*

According to a first embodiment of the invention as shown in FIG. 1*a* to 1*c,* the water tank 130 is filled with water and is engaged to the steam generator 120. The housing 145 is pushed down when the water tank 130 is engaged to the steam generator 120. As a result the pump 141 gets activated to dose an amount of the water treatment agent into the water tank 130. The amount of water treatment agent needed is in the range of 1 to 500 ppm. Therefore, the amount of water treatment agent, sufficient for lifetime use of steaming system can be housed in the cartridge 144. The water treatment agent is preferably in the form of a solution containing a solute and water. The water treatment agent drips or flows into the water tank 130 through the outlet 142 and mixes with water therein. The one way valve 143 acts as a means to de-air in order to balance the air pressure inside and outside the dosing device 140 to ensure smooth functioning of the pump 141. The one way valve 143 lets the air into dosing device 140. This is to compensate for the vacuum that is generated in the dosing device due to pumping of the water treatment agent. This ensures accurate dosing. The one way valve 143 also prevents evaporation of water from the water treatment agent and thus avoids the increase of concentration of the water treatment agent over time. The dosing device 140 is replaceable or is integrated into the water tank 130. If it is a replaceable one, the one way valve can simply be a small de-air hole.

Figure 2A:
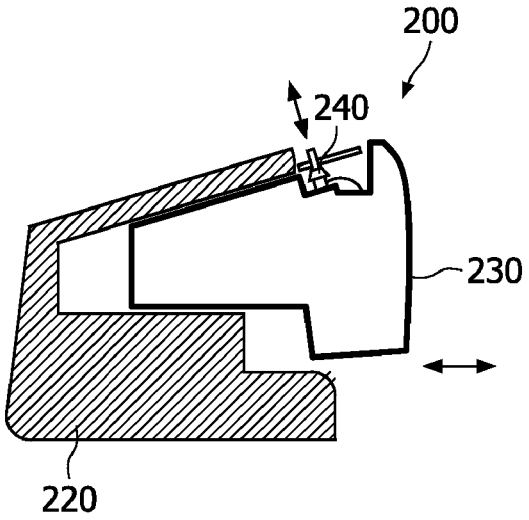
FIG. 2*a* shows a steaming system according to a second embodiment of the invention where a water tank is disengaged.
Figure 2B:
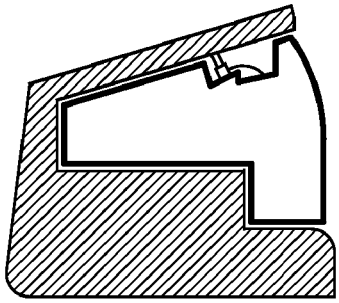
FIG. 2*b* shows the steaming system of FIG. 2*a* where the water tank is engaged.
Figure 2C:
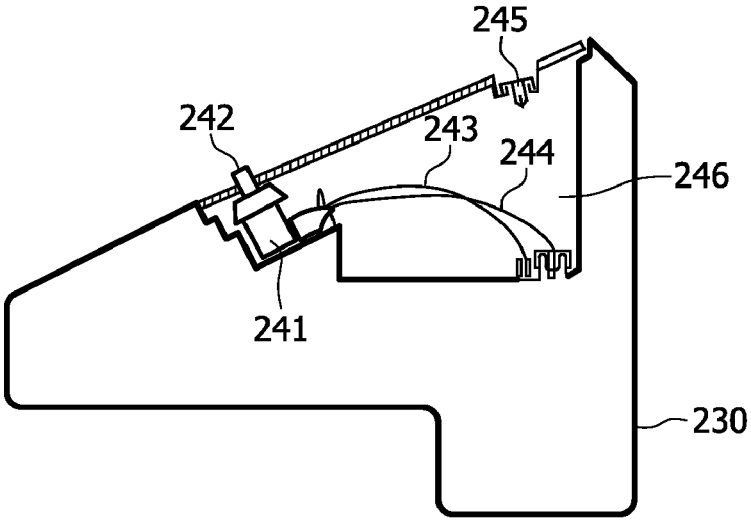
FIG. 2*c* shows an exploded view of the dosing device of FIG. 2*a;*

In FIGS. 2*a* and 2*b,* a steaming system 200 includes a steam generator 220, a water tank 230 and a dosing device 240. The dosing device 240 further consists of a pump 241 with a switch 242, an inlet 243 and an outlet 244. The dosing device 240 also includes a one way valve 245 and a cartridge 246 as shown in FIG. 2*c*.

According to a second embodiment of the invention as shown in FIG. 2, the pump 241 is activated as the switch 242 gets pushed when the water tank 230 gets engaged to the steam generator 220. The one way valve 245 is provided to balance the air pressure inside and outside the dosing device 240 to ensure smooth functioning of the pump 241. If the pump 241 has a self-venting system, the one way valve 245 is not necessary. When the pump 241 gets activated, the water treatment agent from the cartridge 246 is sucked through the inlet 243 and is delivered through the outlet 244 into the water tank 230. The dosing device 240 can be built into water tank or molded as a separate container. The location and orientation of the pump 241 are not limited to this illustration. The pump 241 can dose when the switch 242 is pressed down or dose when the switch 242 is lifted up, depending on the design of the pump 241. In the later case the pump 241 gets activated as the switch 242 is lifted up when the water tank 230 gets disengaged from the steam generator 220.

Figure 3:
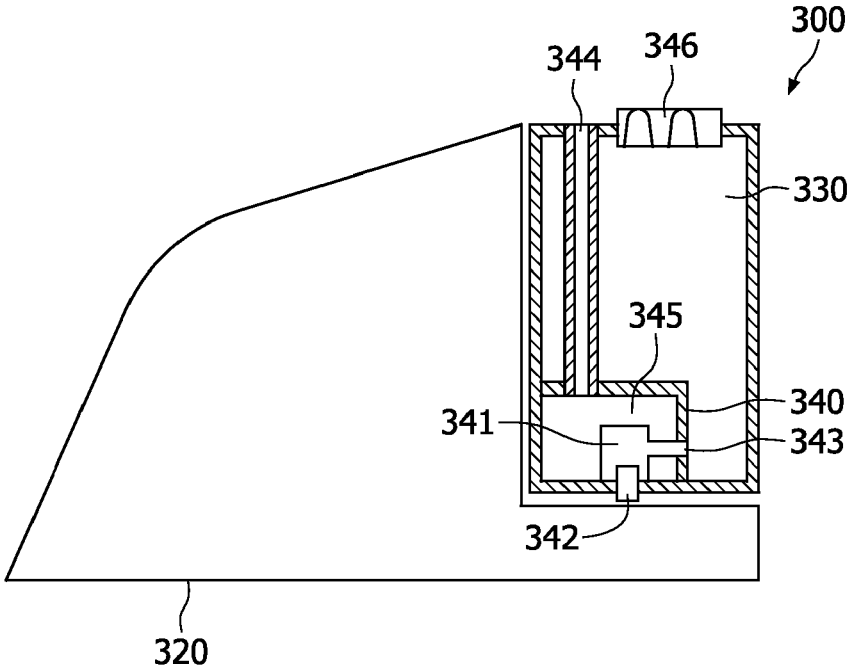
FIG. 3 shows a steaming system according to a third embodiment of the invention.

In FIG. 3, a steaming system 300 includes a steam generator 320, a water tank 330 and a dosing device 340. The dosing device 340 further consists of a pump 341 with a switch 342 and with an outlet 343. The dosing device 340 also includes a one way valve 344 and a cartridge 345.

The pump gets activated as the switch 342 gets pressed when the water tank 330 is engaged to the steam generator 320. The one way valve 344 acts as a means to de-air in order to balance the air pressure inside and outside the dosing device 340 to ensure smooth functioning of the pump 341. Depending on the activation mode of the pump 341, the pump can also be activated to dose when the water tank 330 is disengaged from the steam generator 320.

Figure 4:
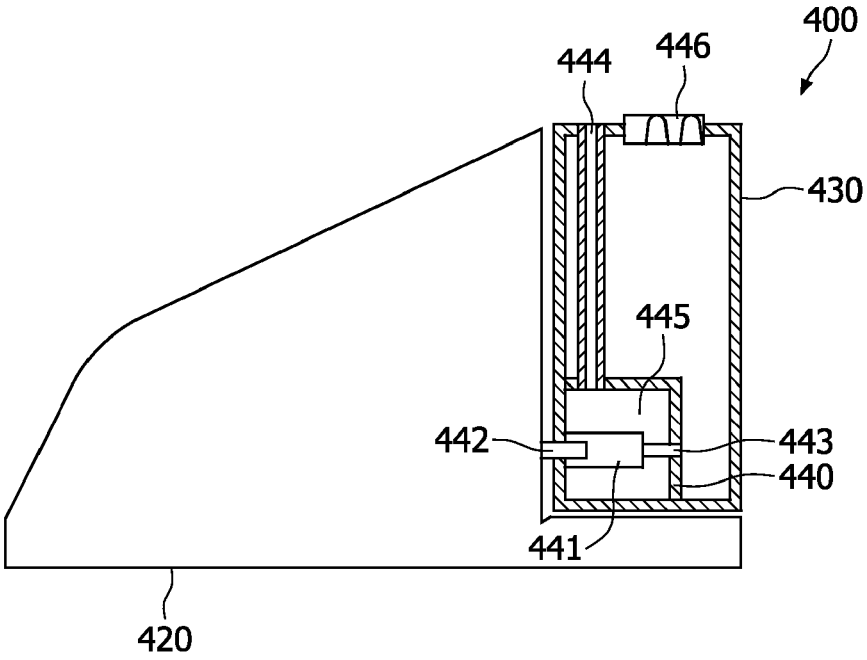
FIG. 4 shows a steam system according to a fourth embodiment of the invention.

FIG. 4 is similar to FIG. 3 with an exception that a pump 441 is placed at the vertical side of the dosing device 440.

The pump gets activated as the switch 442 gets pressed when the water tank 430 is engaged to the steam generator 420. The one way valve 444 acts as a means to de-air in order to balance the air pressure inside and outside the dosing device 440 to ensure smooth functioning of the pump 441. Depending on the activation mode of the pump 441, the pump can also be activated to dose when the water tank 430 is disengaged from the steam generator 440.

Figure 5:
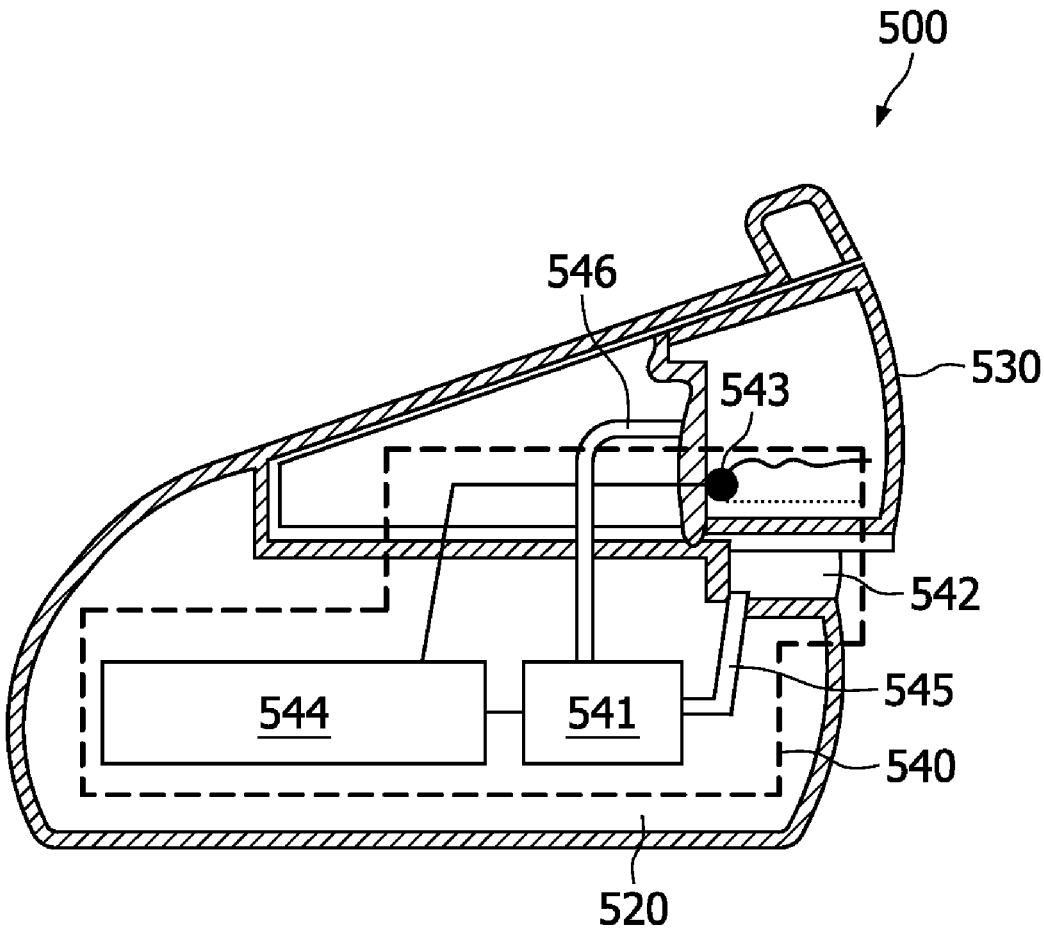
FIG. 5 shows a steaming system according to a fifth embodiment of the invention.

In FIG. 5, a steaming system 500 includes a steam generator 520, a water tank 530 and a dosing device 540. The dosing device 540 consists of a pump 541, a cartridge 542, a sensor 543 and a control member 544. The pump 541 is provided with an inlet 545 and an outlet 546

In the embodiment of the invention shown in FIG. 5, an electrical signal is generated by detecting disengaging or engaging movement of water tank 530 through the sensor 543. The sensor signal is processed by the control member 544 and it activates the pump 541, to dose an amount of the agent into water tank.

Figure 6:
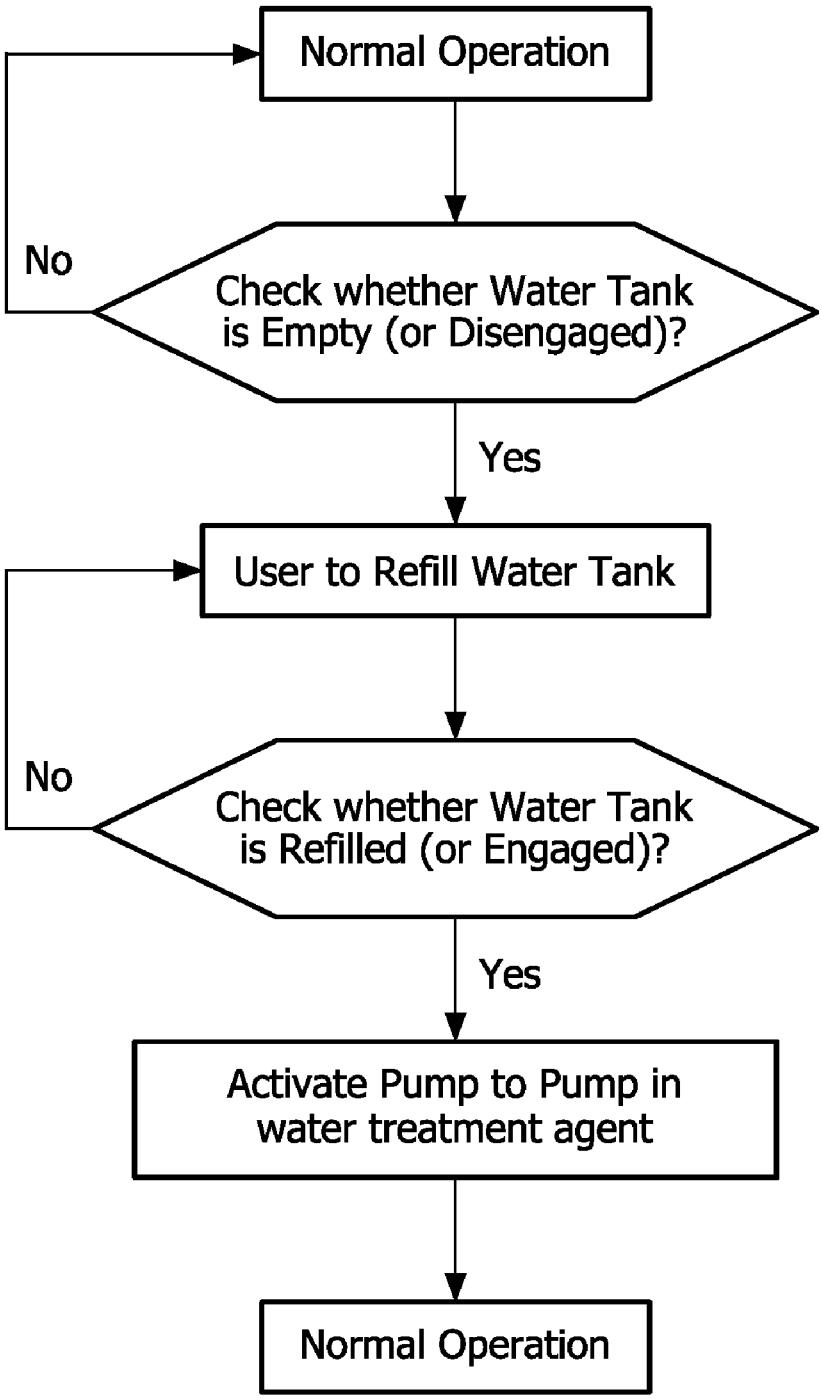
FIG. 6 is the electronic dosing operation flow chart.

FIG. 6 shows the flow chart for dosing operation. The sensor 543 checks whether the water tank 530 is engaged or disengaged. If it is disengaged, the water tank 530 has to be refilled by the user. After refilling, the user engages the water tank 530. The sensor senses the water tank 530 and activates the pump 541 to dose an amount of the water treatment agent into the water tank 530 from the cartridge 542. The location of the cartridge 542 is to facilitate the direct communication of the agent in the cartridge 542 to the pump 541 and to the water tank 530.

Figure 7:
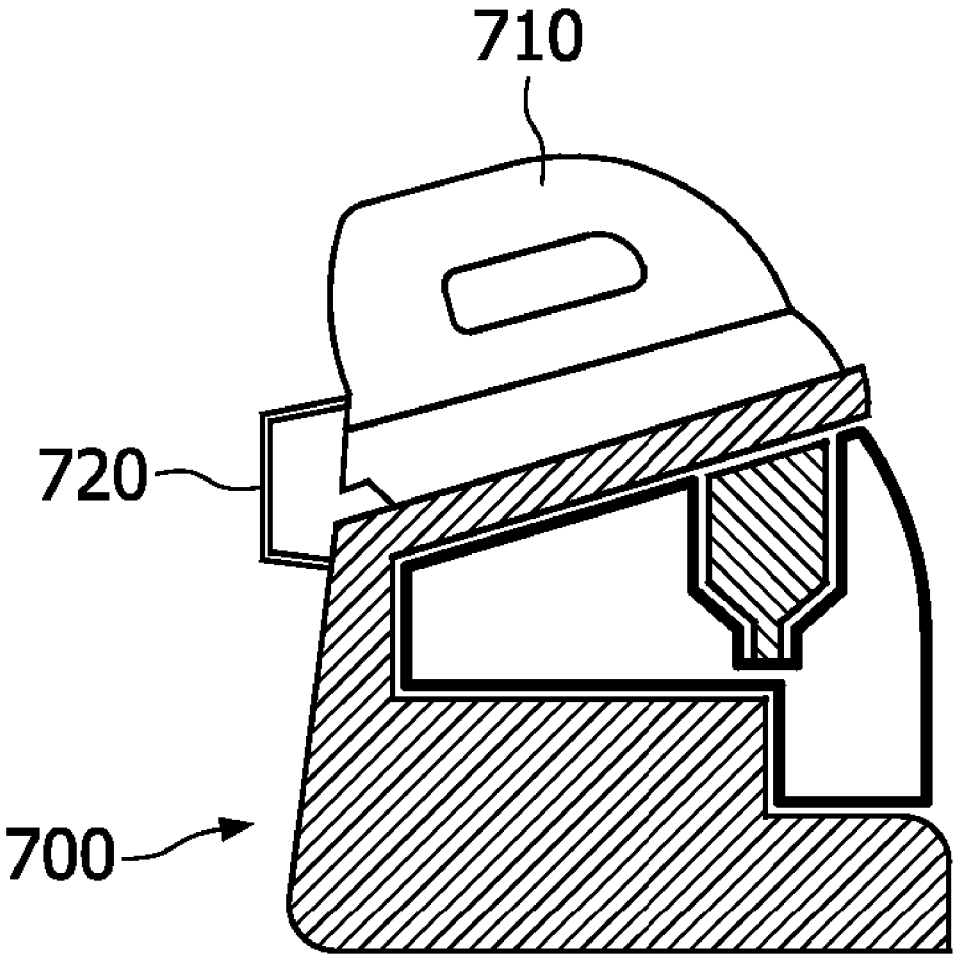
FIG. 7 shows an iron device using the steaming system according to any of the above mentioned embodiments.

FIG. 7 shows an iron device 710 with a steaming system 700. The steam generated in the steaming system is sent to the iron 710 through a hose 720.

It is to be understood that although preferred embodiments, specific constructions and configurations have been discussed herein according to the present invention, various changes or modifications in form and detail may be made without departing from the scope and spirit of this invention.

The invention claimed is:

1. A steaming system comprising:

a steam generator;

a removable water tank for holding and supplying water to the steam generator; and a dosing device for supplying an amount of a water treatment agent to the water tank, wherein the dosing device is configured to be triggered by a movement of the water tank relative to the steam generator.

2. The steaming system as claimed in claim 1, wherein the dosing device comprises:

a cartridge for holding the water treatment agent;

a pump for pumping the water treatment agent from the cartridge to the water tank; and a valve for balancing air pressure inside the cartridge while the water treatment agent is being pumped.

3. The steaming system as claimed in claim 1, wherein the dosing device further comprises a movable housing for housing the pump, wherein said housing is configured to be moved up and down by the movement of the water tank relative to the steam generator and wherein the pump is configured to be activated by the movement of the housing.

4. The steaming system as claimed in claim 1, wherein the dosing device further comprises a switch for activating the pump, wherein said switch is arranged to be activated as a result of said movement of the water tank relative to the steam generator.

5. The steaming system as claimed in claim 1, wherein the dosing device further comprises:

a sensor for sensing the movement of the water tank and generating a signal; and a control member for activating the pump based on said signal.

6. The steaming system as claimed in claim 1, wherein the water treatment agent is an anti-foaming agent, an anti-scaling agent or a combination of both.

7. An iron device comprising the steaming system as claimed in claim 1.

* * * * *